US008519604B2

(12) United States Patent
Lee et al.

(10) Patent No.: US 8,519,604 B2
(45) Date of Patent: Aug. 27, 2013

(54) FIELD EMISSION PANEL WITH A CHARGING PREVENTION RESISTANCE UNIT

(75) Inventors: Byong-gon Lee, Suwon-si (KR); Zin-min Park, Asan-si (KR); Seung-hyun Son, Hwaseong-si (KR); Ji-hong Lim, Suwon-si (KR); Jin-hwan Hwang, Cheonan-si (KR); Hyeon-seok Kim, Suwon-si (KR); Seong-gi Choo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/444,406

(22) Filed: Apr. 11, 2012

(65) Prior Publication Data

US 2013/0002119 A1 Jan. 3, 2013

(30) Foreign Application Priority Data

Jun. 28, 2011 (KR) ..... 10-2011-0062863

(51) Int. Cl.
*H01J 43/00* (2006.01)
*H01J 17/00* (2006.01)
*H01J 17/04* (2012.01)

(52) U.S. Cl.
USPC ..... 313/106; 313/107; 313/567; 313/605; 313/631

(58) Field of Classification Search
None
See application file for complete search history.

(56) References Cited

U.S. PATENT DOCUMENTS

| | | | | |
|---|---|---|---|---|
| 6,656,007 | B2 * | 12/2003 | Fushimi et al. | 445/24 |
| 7,053,537 | B2 | 5/2006 | Hiroike et al. | |
| 7,298,074 | B2 | 11/2007 | Yamazaki | |
| 7,537,503 | B2 | 5/2009 | Hiroike et al. | |
| 2004/0245916 | A1 | 12/2004 | Hiroike et al. | |
| 2005/0146260 | A1 | 7/2005 | Yamazaki | |
| 2006/0141892 | A1 | 6/2006 | Hiroike et al. | |
| 2009/0175027 | A1 | 7/2009 | Jung et al. | |
| 2010/0141866 | A1 | 6/2010 | Ryu et al. | |

FOREIGN PATENT DOCUMENTS

| | | | |
|---|---|---|---|
| JP | 10284285 | A | 10/1998 |
| KR | 20030088302 | A | 11/2003 |
| KR | 1020050072059 | A | 7/2005 |
| KR | 100593524 | B1 | 6/2006 |
| KR | 100913179 | B1 | 8/2009 |
| KR | 1020100064330 | A | 6/2010 |
| KR | 1020100132343 | A | 12/2010 |

* cited by examiner

*Primary Examiner* — Natalie Walford
(74) *Attorney, Agent, or Firm* — Sughrue Mion, PLLC

(57) ABSTRACT

A field emission panel is provided. The field emission panel includes a first substrate and a second substrate, a sealing member and a plurality of spaces which are disposed between the first substrate and the second substrate, a plurality of concave portions which are formed on a surface of the first substrate, a plurality of cathode electrodes which are disposed within each of the plurality of concave portions, a plurality of field emission materials which are disposed on each of the cathode electrodes, a plurality of gate electrodes which are fixed to areas of the surface of the first substrate which separate the concave portions of the first substrate with a gap therebetween, a light emission unit which is disposed on the second substrate, and a charging prevention resistance unit which is disposed on the first substrate, on a gap between a pair of gate electrodes.

20 Claims, 9 Drawing Sheets

FIELD EMISSION PANEL WITH A CHARGING PREVENTION RESISTANCE UNIT

CROSS-REFERENCE TO RELATED APPLICATIONS

This application claims priority from Korean Patent Application No. 10-2011-0062863, filed on Jun. 28, 2011, in the Korean Intellectual Property Office, the disclosure of which is incorporated herein by reference in its entirety.

BACKGROUND

1. Field

Methods and apparatuses consistent with exemplary embodiments relate to a field emission panel.

2. Description of the Related Art

A field emission material refers to a material that emits electrons if an electric field is generated around it in a vacuum. A representative example of the field emission material is a carbon nano tube. Using such a field emission material, a panel generating light may be manufactured. Hereafter, this type of panel will be referred to as a "field emission panel."

A related-art field emission panel may expose a substrate or an insulation layer between gate electrodes in view of a structure of the substrate in the panel. At this time, if a predetermined driving voltage is applied to the related-art field emission panel, the exposed surface may be charged. Also, the related-art field emission panel is provided with a spacer for supporting opposite substrates in the panel. However, there is a problem in that the spacer is charged due to a voltage (electric potential difference) between the opposite substrates or due to backscattering generated when electrons emitted from the field emission material or accelerated electrons collide with the substrate.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiment provides a field emission panel which can prevent electric charge from occurring therein.

According to an aspect of an exemplary embodiment, there is provided a field emission panel comprising: a first substrate and a second substrate which face each other; a sealing member which is disposed between the first substrate and the second substrate; a plurality of spacers which are disposed between the first substrate and the second substrate to maintain a constant gap between the first substrate and the second substrate inside the sealing member; a plurality of concave parts which are formed on one surface of the first substrate; a plurality of cathode electrodes which are disposed on each of the plurality of concave parts; a plurality of field emission materials which are disposed on each of the cathode electrodes; a plurality of gate electrodes which are fixed to areas of the one surface of the first substrate between the concave parts, away from the field emission materials by a predetermined distance and which are distanced from one another; a light emission unit which comprises an anode electrode and a fluorescent layer disposed on one surface of the second substrate; and a charging prevention resistance unit which is disposed on a gap between the each gate electrode on the first substrate.

A width of the charging prevention resistance unit may be larger than the gap between the gate electrodes.

The field emission panel may further comprise a spacer charging prevention resistance unit which is disposed around bottom surfaces of each of the spacers of the first substrate.

The spacer charging prevention resistance unit may enclose the bottom surfaces of the spacers in a circular shape.

The charging prevention resistance unit and the spacer charging prevention resistance unit may have a resistivity of $10^5$~$10^{10}$ Ωcm.

The charging prevention resistance unit and the spacer charging prevention resistance unit may be disposed within a recess which is formed on the first substrate to have a depth corresponding to depth of the concave parts and which extends in a perpendicular direction to the concave parts.

The charging prevention resistance unit and the spacer charging prevention resistance unit may be made of high resistance chromium oxides ($Cr_2O_3$).

The charging prevention resistance unit and the spacer charging prevention resistance unit may be manufactured by thin film deposition.

The charging prevention resistance unit and the spacer charging prevention resistance unit may be manufactured by pattern printing.

The field emission panel may further comprise an edge electrode unit which is disposed on the one surface of the second substrate between the light emission unit and the sealing member.

The spacer adjacent to the sealing member may be disposed between the sealing member and the edge electrode unit.

The spacer adjacent to the sealing member may be disposed between the first substrate and the second substrate in contact with the edge electrode unit.

An electric potential of the edge electrode unit may be lower than an electrical potential of the anode electrode.

An electric potential of the edge electrode unit may be ground (0V).

An electric potential difference between opposite ends of the spacer adjacent to the sealing member may be ground (0V).

The field emission panel may further comprise an interface electrode unit which is disposed between the second substrate and each of the spacers.

The interface electrode unit may be formed by screen printing.

The interface electrode unit may comprise any one of Al, Ag, Cu, Cr, Mo, Zn, In, and C.

The interface electrode unit may have a resistivity of $10^5$ Ωcm or less.

According to the exemplary embodiment, the field emission panel comprises the charging prevention resistance unit formed on the exposed portion between the gate electrodes, so that the exposed portion is prevented from being charged. As such, the field emission panel guarantees driving stability of a device.

Also, according to the exemplary embodiment, the field emission panel comprises the edge electrode unit disposed between the light emission unit and the sealing member so that arching is prevented on the outermost spacer and its surrounding portion.

In addition, according to the exemplary embodiment, the interface electrode unit is disposed between the substrate and the spacer so that abnormal discharge is prevented on the contact interface.

Additional aspects and advantages of the exemplary embodiments will be set forth in the detailed description, will be obvious from the detailed description, or may be learned by practicing the exemplary embodiments.

BRIEF DESCRIPTION OF THE DRAWINGS

The above and/or other aspects will be more apparent by describing in detail exemplary embodiments, with reference to the accompanying drawings, in which.

DETAILED DESCRIPTION

Figure 1:
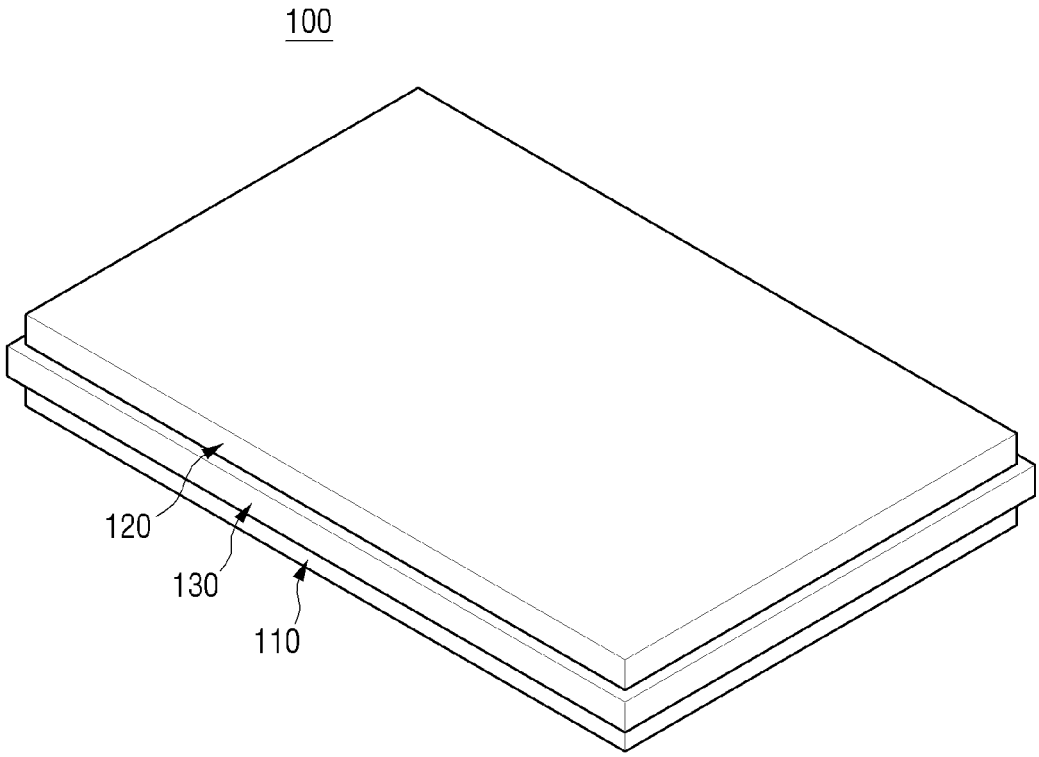
FIG. 1 is a schematic perspective view illustrating a field emission panel according to an exemplary embodiment.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Referring to FIGS. 1 to 4, a field emission panel according to an exemplary embodiment will be explained.

A field emission panel 100 according to an exemplary embodiment comprises a first substrate 110 and a second substrate 120 which face each other, and a sealing member 130 disposed therebetween. The sealing member 130 is disposed around the perimeter of the first substrate 110 and the second substrate 120, between perimeter portions of the first substrate 110 and the second substrate 120 (see FIGS. 7 and 8).

The first substrate 110 has a glass material having light permeability. The first substrate 110 comprises a plurality of concave parts 150 formed on an inner surface thereof with a predetermined depth in a stripe pattern. The concave parts 150 are formed by removing a part of the first substrate 110 by etching or sand blasting.

Each of the concave parts 150 comprises a cathode electrode 160 respectively and a plurality of field emission materials 170 are provided on the cathode electrode 160. The field emission materials 170 may comprise a material selected from the group consisting of carbon nano tube, graphite, graphite nano fiber, diamond, diamond carbon, silicon nano wire, and the like, and any combination thereof.

The concave parts 150 are formed to have a width larger than that of the cathode electrode 160 and to have a depth larger than a sum of a thickness of the cathode electrode 160 and thickness of the field emission materials 170. The concave parts 150 may have a vertical side wall or an inclined side wall.

The field emission materials 170 are field emission layers with a predetermined thickness and may be formed by thick film processing such as screen printing.

The concave parts 150 have the depth larger than the sum of the thickness of the cathode electrode 160 and the thickness of the field emission material 170. Therefore, the field emission materials 170 are also formed lower than a top surface 111 of the first substrate 110 with a predetermined height difference.

A plurality of gate electrodes 180 are manufactured with a metal plate having a thickness larger than that of the cathode electrode 160 and comprises a plurality of openings 185 to allow electrons emitted from the field emission materials 170 to pass therethough.

The gate electrodes 180 may be formed of an alloy of nickel and iron or any other metal material, and may be 50~100 μm thick and 10 mm wide.

The gate electrodes 180 are manufactured by a separate process from that of the cathode electrode 160 and the field emission materials 170 and are then fixed on top surfaces 111 of the first substrate 110 in a cross direction to the cathode electrode 160 such that the gate electrodes 180 extend over multiple concave parts 150. The gate electrodes 180 are located away from one another by a predetermined distance.

A charging prevention resistance unit 200 is formed on a portion of the first substrate 110 that is exposed between the gate electrodes 180 when the gate electrodes 180 are arranged.

The charging prevention resistance unit 200 has a width larger than a gap between the gate electrodes 180.

Also, the charging prevention resistance unit 200 may be formed of high resistance chromium oxides ($Cr_2O_3$), for example.

Since low resistivity of the charging prevention resistance unit 200 may cause disconnection between electrodes, the resistivity of the charging prevention resistance unit 200 may be $10^5$~$10^{10}$ Ωcm. Also, the charging prevention resistance unit 200 may be less likely to emit electrons secondarily due to emission electron, backscattering electron, positive ion, etc.

A plurality of spacers 140 are provided between the first substrate 110 and the second substrate 120 to maintain a constant gap between the first substrate 110 and the second substrate 120 inside the sealing member 130.

The spacers 140 are formed in a column shape and are arranged to form a plurality of rows.

The first substrate 110 comprises a spacer charging prevention resistance unit 220 formed around a bottom surface of each spacer 140.

The spacer charging prevention resistance unit 220 may be formed of high resistance chromium oxides ($Cr_2O_3$) like the charging prevention resistance unit 200, and may have resistivity of $10^5$~$10^{10}$ Ωcm and also may be less likely to emit electrons secondarily.

The spacer charging prevention resistance unit 220 may enclose the bottom surface of each of the spacers 140 in a circular shape.

Figure 2:
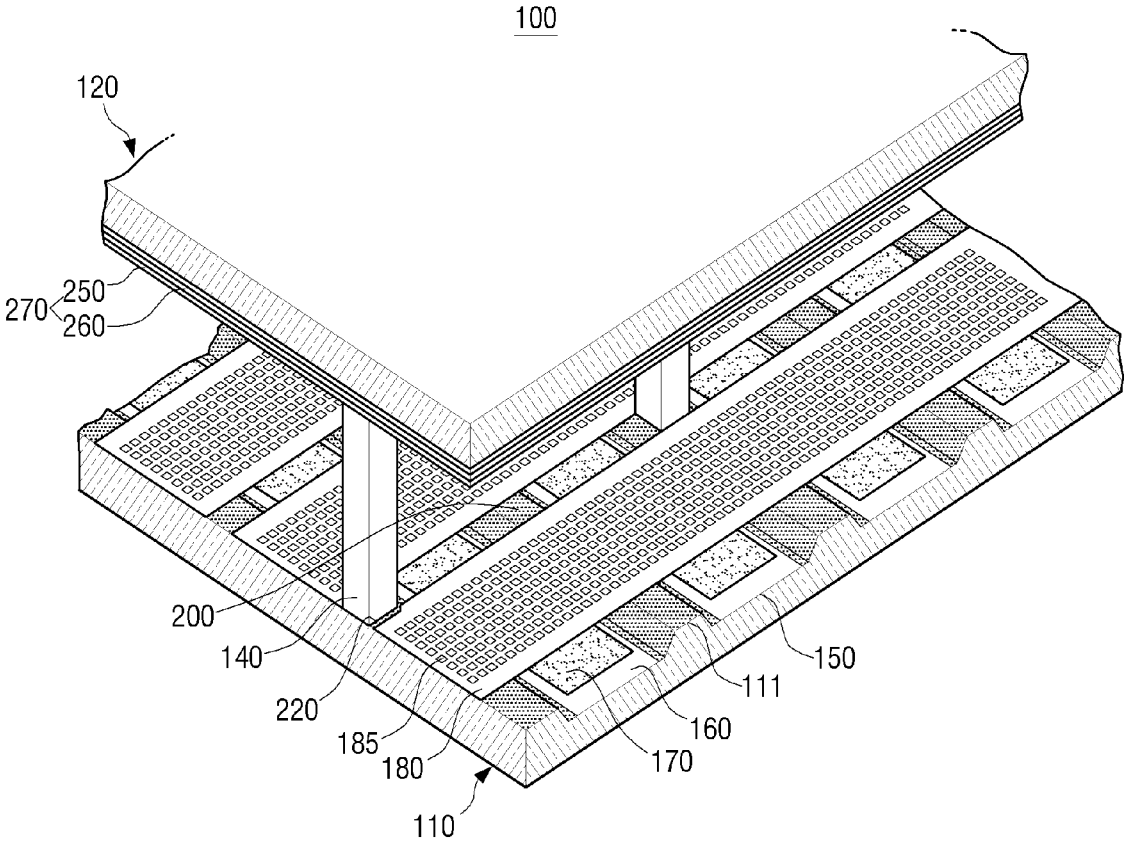
FIG. 2 is a schematic perspective view illustrating an inner structure of the field emission panel according to an exemplary embodiment.
Figure 3:
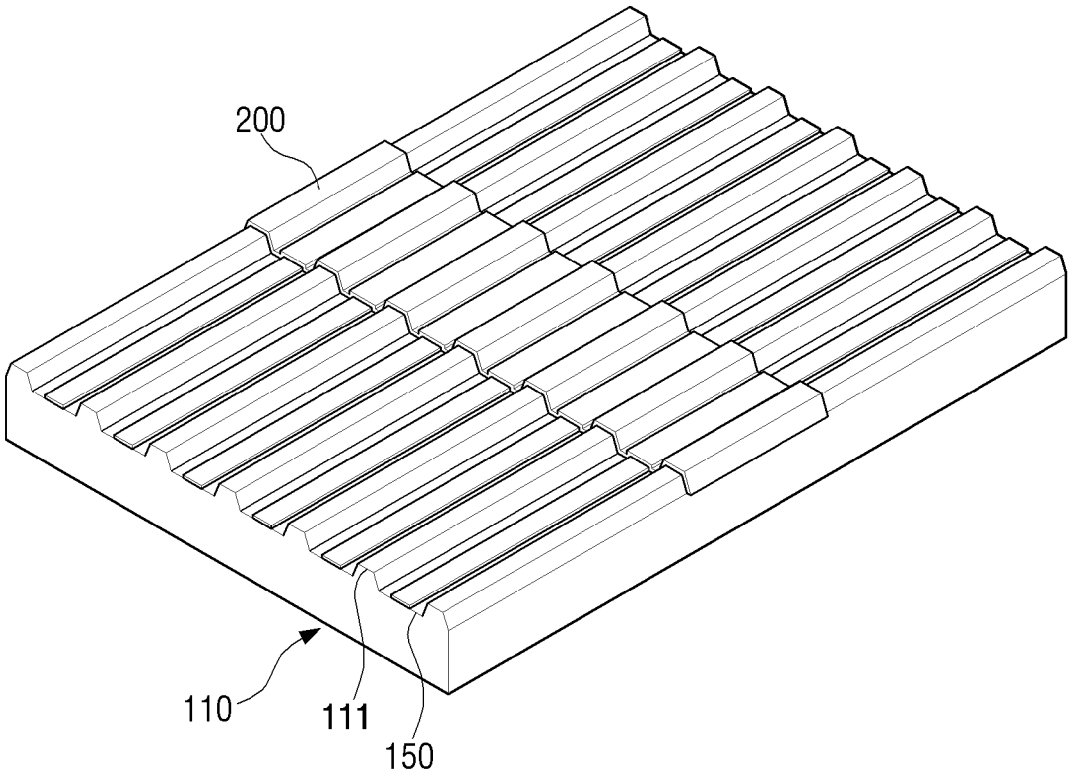
FIG. 3 is a schematic perspective view illustrating a first substrate on which a charging prevention resistance unit is disposed according to an exemplary embodiment.
Figure 4:
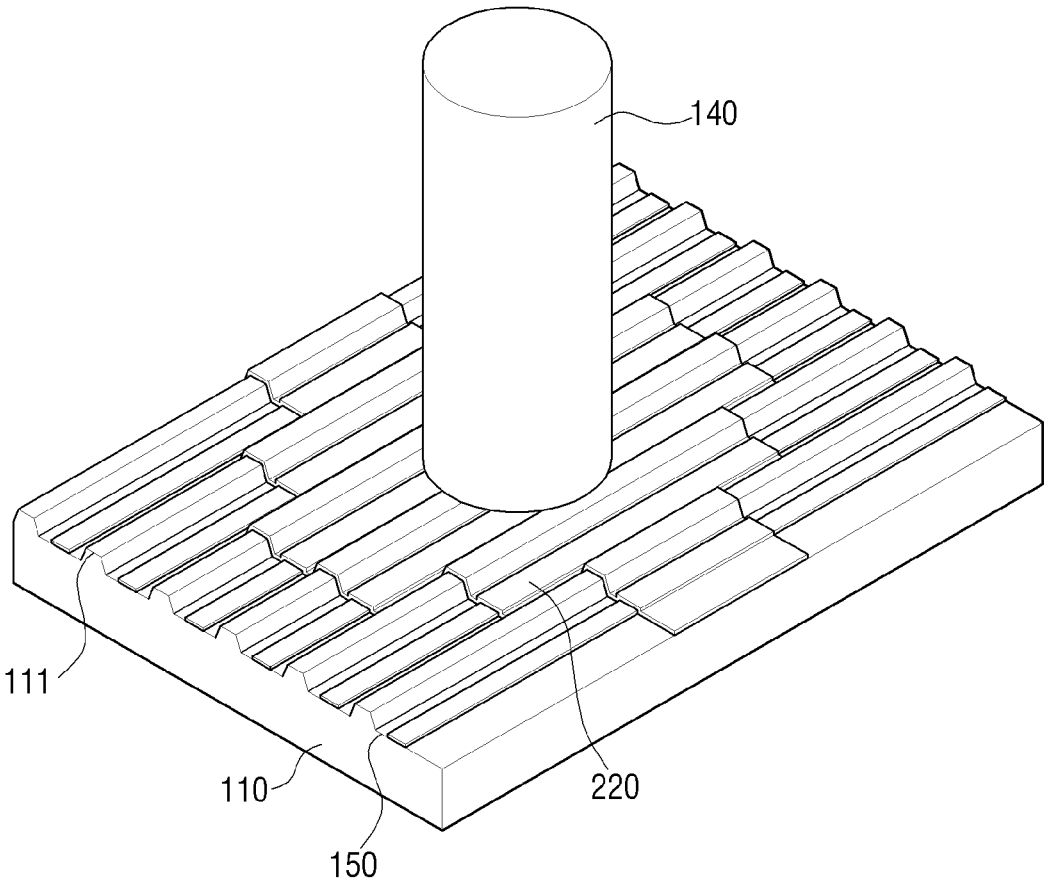
FIG. 4 is a schematic perspective view illustrating the first substrate on which a spacer charging prevention resistance unit is disposed according to an exemplary embodiment.

As shown in FIGS. 2-4, the charging prevention resistance unit 200 and the spacer charging prevention resistance unit 220 may be manufactured by thin film deposition or pattern printing, and may contact or be formed over an electrode pattern which has been already formed on the first substrate 110. As such, the charging prevention resistance unit 200 and the spacer charging prevention resistance unit 220 are able to extract an electric charge that is generated and accumulated when an element is driven, so that driving instability caused by arcing, for example, can be reduced.

The second substrate 120 has a glass material having light permeability like the first substrate 110.

A light emission unit 270 comprising an anode electrode 250 and a fluorescent layer 260 is provided on a bottom surface of the second substrate 120 which faces the upper surface of the first substrate. Here, the anode electrode 250 is formed as the bottom most layer of the second substrate 120.

The anode electrode 250 forms an electric field with the gate electrodes 180 therebetween, and the electrons emitted from the field emission materials 170 are accelerated toward the second substrate 120 due to the electric field. The accelerated electrons collide with the fluorescent layer 260 so that light is generated from the fluorescent layer 260.

Hereinafter, an operation of the field emission panel 100 according to an exemplary embodiment will be explained.

If voltages are applied to the cathode electrode 160, the gate electrodes 180, and the anode electrode 250, an electric field necessary for emission and acceleration of electrons is generated. That is, due to the electric field generated between the cathode electrode 160 and the gate electrodes 180, the electrons are emitted from the field emission materials 170 and the accelerated electrons are accelerated toward the fluorescent layer 260 due to the electric field generated between the gate electrodes 180 and the anode electrode 250. When the accelerated electrons collide with the fluorescent layer 260, the light is generated from the fluorescent layer 260.

The fluorescent layer 260 comprises a red-fluorescent substance corresponding to red light, a green-fluorescent substance corresponding to green light, and a blue-fluorescent substance corresponding to blue light. These three types of fluorescent substances may be uniformly distributed over the second substrate 120 in the fluorescent layer 260 without a specific pattern, and white light may be generated from the fluorescent layer 260. The field emission panel 100 comprising the fluorescent layer 260 generating the white light may be used as a backlight unit for a display apparatus. In another exemplary embodiment, the three types of fluorescent substances may be distributed over the second substrate 120 with a specific pattern. For example, many fluorescent groups consisting of a red-fluorescent substance, a green-fluorescent substance, and a blue-fluorescent substance may be distributed over the second substrate 120 in a regular pattern. From the fluorescent layer 260, multi-color light may be generated and accordingly a color image can be realized. The field emission panel 100 comprising the fluorescent layer 260 capable of realizing a color image may be used as a display panel of a field emission display.

If a predetermined driving voltage is applied to the field emission panel 100 according to the exemplary embodiment, the first substrate 110 or the spacers 140 are prevented from being charged by a voltage (electric potential difference) between the first substrate 100 and the second substrate 120 or backscattering which is generated after the electrons emitted from the field emission materials 170 or the accelerated electrons collide with the second substrate 120, due to the presence of the charging prevention resistance unit 200, which is formed on the portion of the first substrate 110 exposed between the gate electrodes 180, and the presence of the spacer charging prevention resistance unit 220 formed around the spacers 140.

Figure 5:
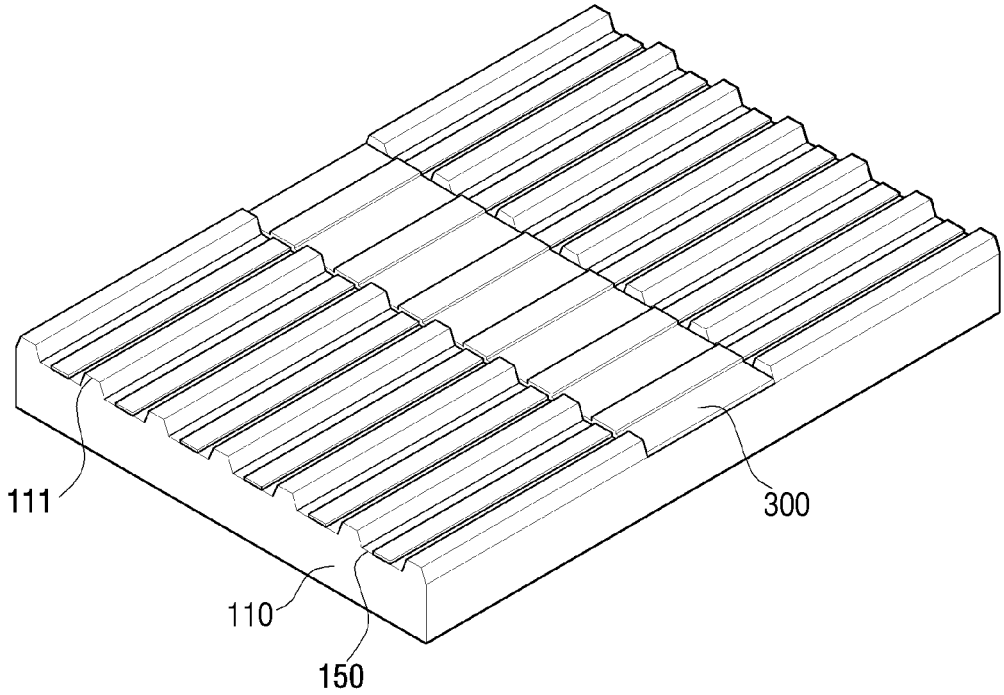
FIG. 5 is a schematic perspective view illustrating a first substrate on which another charging prevention resistance unit is disposed according to an exemplary embodiment.
Figure 6:
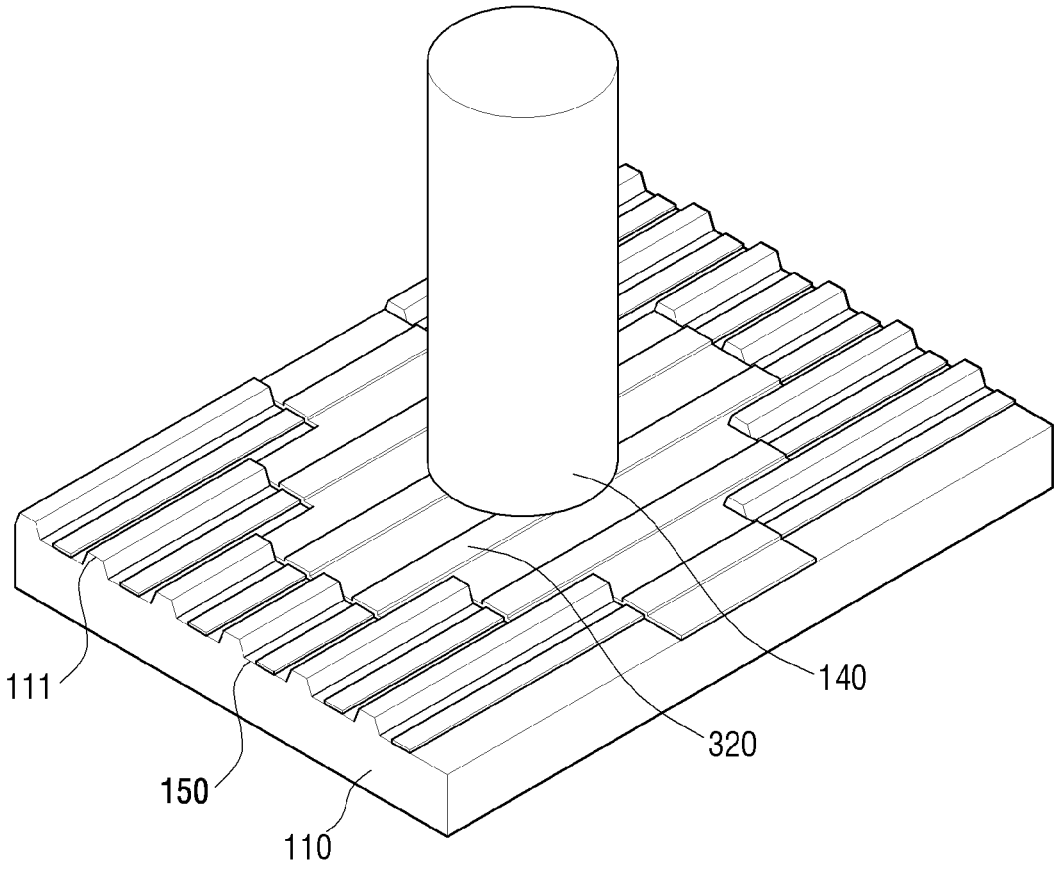
FIG. 6 is a schematic perspective view illustrating a first substrate on which another spacer charging prevention unit is disposed according to an exemplary embodiment.

FIGS. 5 and 6 are views illustrating another example of a charging prevention resistance unit and a spacer charging prevention resistance unit according to an exemplary embodiment.

The same configuration as in the above exemplary embodiment is not explained below.

As shown in FIGS. 5 and 6, a charging prevention resistance unit 300 and a spacer charging prevention resistance unit 320 are formed in recesses which have the same depth as that of the concave parts 150 and which cut across in a perpendicular direction to the concave parts 150. Accordingly, contact stability between the charging prevention resistance unit 300 and the spacer charging prevention resistance unit 320 and the first substrate 110 increases.

Figure 7:
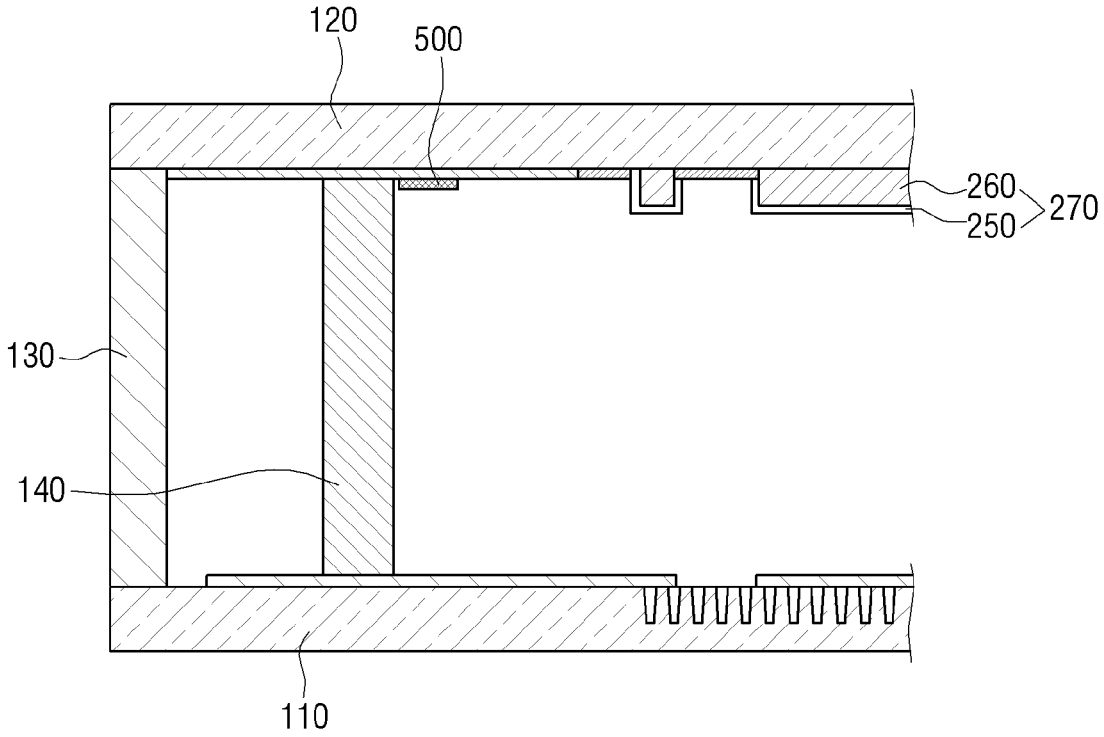
FIG. 7 is a schematic cross sectional view illustrating a portion around an outermost spacer according to an exemplary embodiment.
Figure 8:
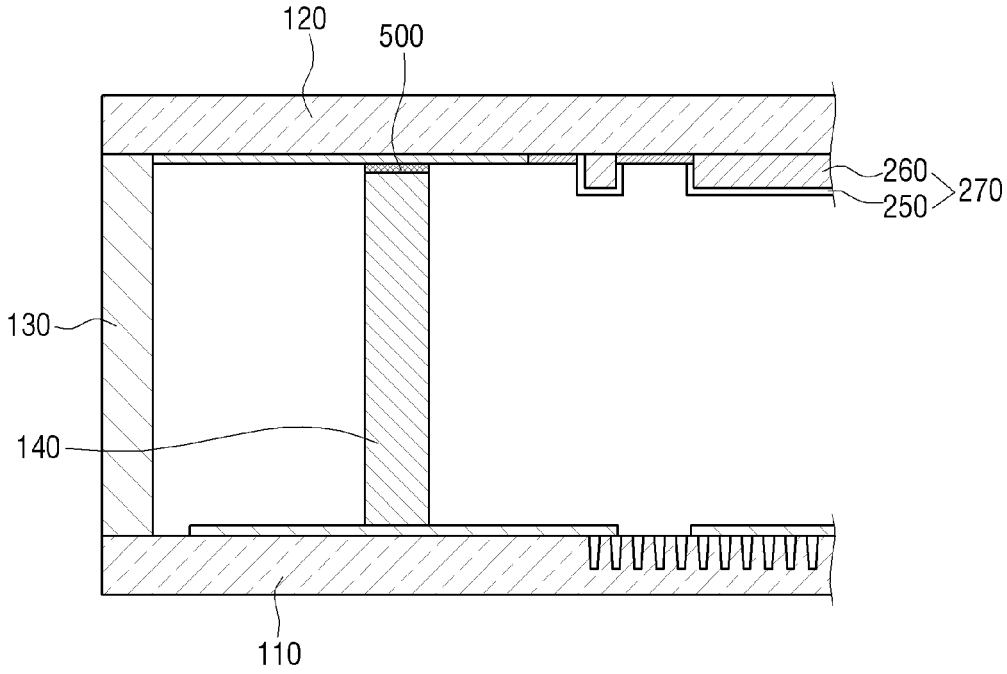
FIG. 8 is a schematic cross sectional view illustrating a portion around another outermost spacer according to an exemplary embodiment.

Also, as shown in FIGS. 7 and 8, an edge electrode unit 500 is provided on an inner surface of the second substrate 120 between the sealing member 130 and the light emission unit 270.

An electric potential of the edge electrode unit 500 is lower than that of the anode electrode 250 and may be ground (0V).

The spacer 140 is provided between the sealing member 130 and the edge electrode unit 500, as shown in FIG. 7, or the spacer 140 may be in contact with a lower surface of the edge electrode unit 500, as shown in FIG. 8. The spacer 140 may be provided between the first and the second substrates 110 and 120.

An electric potential difference between opposite ends of the spacer 140 may be ground (0V).

According to the above-described configuration of the field emission panel 100 according to the exemplary embodiments, arcing or abnormal light emitting is prevented around the spacer 140 formed on the outermost portion.

Figure 9:
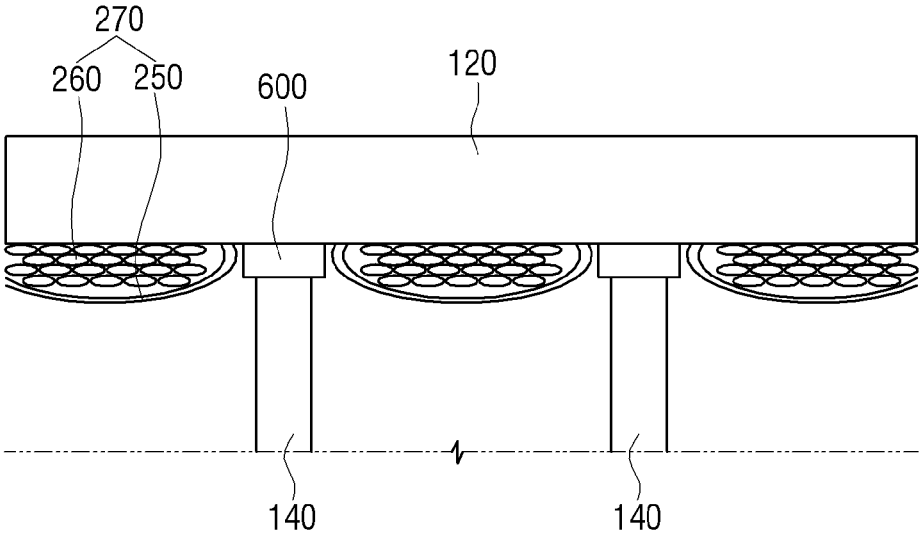
FIG. 9 is a schematic cross sectional view illustrating an interface electrode unit according to an exemplary embodiment.

According to an exemplary embodiment, the field emission panel 100 comprises an interface electrode unit 600 formed between the second substrate 120 and each of the spacers 140, as shown in FIG. 9.

The interface electrode unit 600 may be formed by screen printing and may comprise at least one of Al, Ag, Cu, Cr, Mo, Zn, In, and C.

The interface electrode unit 600 may be formed of a material with resistivity of $10^5$ Ωcm or less.

According to the above-described configuration of the field emission panel 100 according to the exemplary embodiment, an electric charge on a contact interface between the second substrate 120 and the spacer 140 is prevented from being trapped and thus arcing or abnormal light emitting is prevented.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A field emission panel comprising:

a first substrate having a surface in which a plurality of concave portions are formed;

a second substrate which faces the surface the first substrate;

a sealing member which is disposed between the first substrate and the second substrate at a first perimeter region of the first substrate and a second perimeter region of the second substrate;

a plurality of spacers which are disposed between the first substrate and the second substrate and maintain a gap between the first substrate and the second substrate inside the first perimeter and the second perimeter;

a plurality of cathode electrodes which are disposed on the first surface of the first substrate within each of the plurality of concave parts;

a plurality of field emission materials which are disposed on each of the plurality of cathode electrodes;

a plurality of gate electrodes which are fixed to areas of the surface of the first substrate between the concave portions away from the plurality of field emission materials by a predetermined distance and which are separated from other gate electrodes of the plurality of gate electrodes;

a light emission unit which comprises an anode electrode and a fluorescent layer disposed on a surface of the second substrate which faces the first substrate; and a charging prevention resistance unit which is disposed on the first substrate, on a gap between a pair of gate electrodes of the plurality of gate electrodes.

2. The field emission panel as claimed in claim 1, wherein a width of the charging prevention resistance unit is larger than the gap between the pair of gate electrodes.

3. The field emission panel as claimed in claim 1, further comprising a spacer charging prevention resistance unit which is disposed on the surface of the first substrate around a bottom surface of each of the spacers of the first substrate.

4. The field emission panel as claimed in claim 3, wherein the spacer charging prevention resistance unit encloses the bottom surface of the spacers in a circular shape.

5. The field emission panel as claimed in any one of claim 3, wherein the charging prevention resistance unit and the spacer charging prevention resistance unit have a resistivity of $10^5$ to $10^{10}$ Ωcm.

6. The field emission panel as claimed in claim 3, further comprising a recess which has a depth equal to a depth of the plurality of concave portions and which extends in a perpendicular direction to the plurality of concave portions, and wherein the charging prevention resistance unit and the spacer charging prevention resistance unit are disposed in the recess and extend along the recess in the perpendicular direction to the plurality of concave portions.

7. The field emission panel as claimed in claim 3, wherein the charging prevention resistance unit and the spacer charging prevention resistance unit are made of high resistance chromium oxides ($Cr_2O_3$).

8. The field emission panel as claimed in claim 3, wherein the charging prevention resistance unit and the spacer charging prevention resistance unit are disposed by thin film deposition.

9. The field emission panel as claimed in claim 3, wherein the charging prevention resistance unit and the spacer charging prevention resistance unit are disposed by pattern printing.

10. The field emission panel as claimed in claim 1, further comprising an edge electrode unit which is disposed on the surface of the second substrate between the light emission unit and the sealing member.

11. The field emission panel as claimed in claim 10, wherein a spacer of the a plurality of spacers which is adjacent to the sealing member is disposed between the sealing member and the edge electrode unit.

12. The field emission panel as claimed in claim 10, wherein the spacer of the plurality of spacers which is adjacent to the sealing member is disposed between the first substrate and the second substrate in contact with the edge electrode unit.

13. The field emission panel as claimed in claim 10, wherein an electric potential of the edge electrode unit is lower than an electrical potential of the anode electrode.

14. The field emission panel as claimed in claim 10, wherein an electric potential of the edge electrode unit is ground (0V).

15. The field emission panel as claimed in claim 10, wherein an electric potential difference between opposite ends of a spacer of the a plurality of spacers which is adjacent to the sealing member is ground (0V).

16. The field emission panel as claimed in claim 1, further comprising an interface electrode unit which is disposed between the second substrate and each of the plurality of spacers.

17. The field emission panel as claimed in claim 16, wherein the interface electrode unit is formed by screen printing.

18. The field emission panel as claimed in claim 16, wherein the interface electrode unit is made of a material selected from Al, Ag, Cu, Cr, Mo, Zn, In, and C.

19. The field emission panel as claimed in claim 16, wherein the interface electrode unit has a resistivity of $10^5$ Ωcm or less.

20. A field emission panel comprising:

a substrate having a plurality of concave portions and a plurality of areas separating the concave portions formed on a surface of the substrate and which are arranged in an alternating sequence;

a plurality of spacers which extend from the plurality of areas;

a plurality of cathode electrodes which are disposed on the surface of the substrate within each of the plurality of concave portions;

a plurality of field emission materials which are disposed on each of the plurality of cathode electrodes;

a plurality of gate electrodes, each of which is fixed to the plurality of areas of the surface of the substrate away from the plurality of field emission materials by a predetermined distance and each of which is separated from other gate electrodes of the plurality of gate electrodes; and a charging prevention resistance unit which is disposed on the substrate, on gaps formed between each pair of gate electrodes of the plurality of gate electrodes.

* * * * *